US012510081B2

(12) United States Patent
Isono et al.

(10) Patent No.: US 12,510,081 B2
(45) Date of Patent: Dec. 30, 2025

(54) PUMP CASING AND PUMP

(71) Applicant: EBARA CORPORATION, Tokyo (JP)

(72) Inventors: Miho Isono, Tokyo (JP); Shrunali Ranade, Tokyo (JP); Tetsuya Ishiwata, Tokyo (JP); Tsuyoshi Maeda, Tokyo (JP); Takahiro Noji, Tokyo (JP); Masaaki Imafuku, Tokyo (JP); Kazuya Hiramoto, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 0 days.

(21) Appl. No.: 18/579,524

(22) PCT Filed: Apr. 22, 2022

(86) PCT No.: PCT/JP2022/018536

§ 371 (c)(1),
(2) Date: Jan. 16, 2024

(87) PCT Pub. No.: WO2023/002733

PCT Pub. Date: Jan. 26, 2023

(65) Prior Publication Data

US 2024/0328422 A1 Oct. 3, 2024

(30) Foreign Application Priority Data

Jul. 21, 2021 (JP) ..... 2021-120566

(51) Int. Cl.
*F04D 7/04* (2006.01)
*F04D 29/42* (2006.01)

(52) U.S. Cl.
CPC ..... *F04D 7/045* (2013.01); *F04D 29/4286* (2013.01)

(58) Field of Classification Search
CPC ..... F04D 7/045
See application file for complete search history.

(56) References Cited

U.S. PATENT DOCUMENTS

| | | | | |
|---|---|---|---|---|
| 8,657,564 | B2 * | 2/2014 | Cuppetelli | F04D 29/2288 415/121.1 |
| 10,054,136 | B2 * | 8/2018 | Sowa | B02C 18/0092 |
| 10,473,103 | B2 * | 11/2019 | Keeran | F04D 7/045 |
| 12,104,621 | B2 * | 10/2024 | Okuno | F04D 29/4273 |
| 2019/0257320 | A1 | 8/2019 | Petit et al. | |
| 2021/0040957 | A1 | 2/2021 | Petit et al. | |
| 2024/0328422 | A1 * | 10/2024 | Isono | F04D 7/045 |

FOREIGN PATENT DOCUMENTS

| | | | | |
|---|---|---|---|---|
| CH | 411584 A * | 4/1966 | | |
| DE | 102004058458 B3 * | 5/2006 | | F04D 13/12 |
| JP | S49-005009 U | 1/1974 | | |

(Continued)

OTHER PUBLICATIONS

Machine translation of JPS5357507A (May 24, 1978) (Year: 1978).*

(Continued)

*Primary Examiner* — Christopher R Legendre
(74) *Attorney, Agent, or Firm* — Chrisman Gallo Tochtrop LLC

(57) ABSTRACT

A pump casing and a pump. The pump casing includes a cutter having an upper surface facing a leading edge portion of an impeller when the impeller is housed in the pump casing. The upper surface has a region with at least two angles.

18 Claims, 11 Drawing Sheets

(56) References Cited

FOREIGN PATENT DOCUMENTS

| | | | |
|---|---|---|---|
| JP | S52-041904 | A | 3/1977 |
| JP | S53-057507 | A | 5/1978 |
| JP | S54-176101 | U | 12/1979 |
| JP | S56-041488 | A | 4/1981 |
| JP | 2019-143630 | A | 8/2019 |
| WO | 2021/028246 | A1 | 2/2021 |

OTHER PUBLICATIONS

International Search Report issued in Patent Application No. PCT/JP2022/018536 dated Jun. 21, 2022.
Supplementary European Search Report for 22845672 dated May 28, 2025.

* cited by examiner

PUMP CASING AND PUMP

TECHNICAL FIELD

The present invention relates to a pump casing and a pump.

BACKGROUND ART

A pump (especially volute pump) is used to transfer a liquid such as sewage flowing through a sewer pipe.

CITATION LIST

Patent Literature

Patent document 1: Japanese laid-open patent publication No. 2019-143630

SUMMARY OF INVENTION

Technical Problem

Such sewage may contain foreign matter such as a fibrous substance or a solid substance. If such foreign matter adheres to and accumulates on a vane of an impeller, the pump may be blocked by the foreign matter.

Therefore, the present invention provides a pump casing and a pump that can prevent a blockage of the pump by the foreign matter.

Solution to Problem

In an embodiment, there is provided a pump casing capable of housing an impeller, comprising a cutter having an upper surface facing a leading edge portion of the impeller when the impeller is housed in the pump casing, the upper surface having a region with at least two angles.

In an embodiment, the region is divided into: an inner end side region arranged on an inner end side of the leading edge portion; and an outer end side region arranged on an outer end side of the leading edge portion, and an angle between the inner end side region and the leading edge portion is larger than an angle between the outer end side region and the leading edge portion.

In an embodiment, the region is divided into: an inner end side region arranged an inner end side of the leading edge portion; and an outer end side region arranged on an outer end side of the leading edge portion, and an angle between the outer end side region and the leading edge portion is larger than an angle between the inner end side region and the leading edge portion.

In an embodiment, the upper surface has a boundary portion, the boundary portion dividing the region into an inner end side region arranged on an inner end side of the leading edge portion and an outer end side region arranged on an outer end side of the leading edge portion, and a gap between the boundary portion and the leading edge portion is smaller than a gap between the inner end side region and the leading edge portion and a gap between the outer end side region and the leading edge portion.

In an embodiment, the boundary portion has a curved shape that smoothly connects the inner end side region and the outer end side region.

In an embodiment, the boundary portion has an angular shape that connects the inner end side region and the outer end side region at a predetermined angle.

In an embodiment, the pump casing comprises: a casing body capable of arranging around the impeller; and a casing liner connected to the casing body and to which the cutter is fixed.

In an embodiment, the cutter is constructed of a different member from the casing liner.

In an embodiment, the cutter is an integrally molded member with the casing liner.

In an embodiment, the cutter has: a forward side surface located forward in a direction of rotation of the impeller when the impeller is housed in the pump casing; and a backward side surface located backward in the direction of rotation of the impeller when the impeller is housed in the pump casing, and the forward side surface and the backward side surface are connected to the upper surface.

In an embodiment, the forward side surface has a planar shape.

In an embodiment, the forward side surface has a shape bent at a predetermined angle.

In an embodiment, the forward side surface has a curved surface shape.

In an embodiment, the pump casing has a suction port and a discharge port, and the cutter is arranged on an opposite side of the discharge port with respect to a center of the suction port.

In an embodiment, the pump casing has a groove formed on an inner surface of the pump casing, and the groove is arranged adjacent to the cutter.

In an embodiment, there is provided a pump, comprising: an impeller; and a pump casing described above, the pump casing housing the impeller.

Advantageous Effects of Invention

The pump casing includes a cutter facing the leading edge portion of the impeller. Thus, even if the foreign matter contained in the liquid is sucked into the pump casing, the cutter cuts (and/or grinds) the foreign matter. As a result, the pump casing can prevent blockage of the pump by the foreign matter.

DESCRIPTION OF EMBODIMENTS

Embodiments are described below with reference to the drawings.

Figure 1:
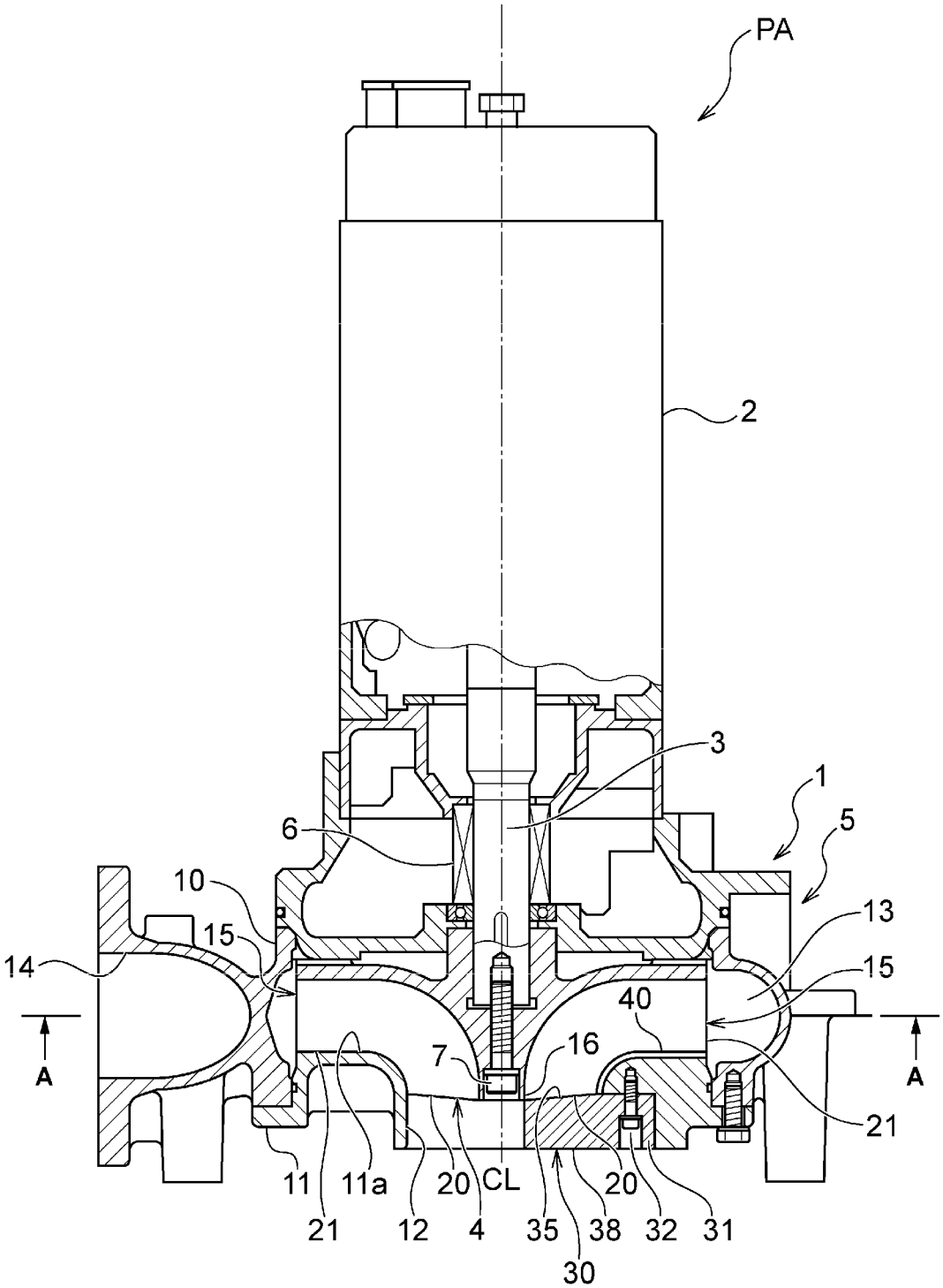
FIG. 1 is a view showing an embodiment of a pump apparatus.

FIG. 1 is a view showing an embodiment of a pump apparatus. As shown in FIG. 1, a pump apparatus PA includes a pump 1 for transferring a liquid, and a motor 2 for driving the pump 1. In the embodiment shown in FIG. 1, the pump 1 is a volute pump for transferring a liquid such as sewage flowing through a sewer pipe.

The pump 1 includes a rotational shaft 3 coupled to the motor 2, an impeller 4 fixed to an end of the rotational shaft 3, and a pump casing 5 that houses the impeller 4. The rotational shaft 3 is rotated by the motor 2, and the impeller 4 rotates with the rotational shaft 3 in the pump casing 5. A mechanical seal 6 attached to the rotational shaft 3 is arranged between the motor 2 and the impeller 4. The mechanical seal 6 prevents the liquid sucked into the pump 1 from entering the motor 2.

The pump casing 5 includes a casing body 10 arranged around the impeller 4 and a casing liner 11 connected to the casing body 10. The casing liner 11 has a suction port 12 formed in a central portion of the casing liner 11. The casing body 10 has a volute chamber (vortex chamber) 13 formed therein and a discharge port 14 connected to the volute chamber 13. The volute chamber 13 has a shape surrounding the impeller 4.

The impeller 4 is fixed to the end of the rotational shaft 3 by a fastener 7. When the impeller 4 rotates by driving the motor 2, the liquid is sucked in through the suction port 12. Velocity energy is imparted to the liquid by the rotation of the impeller 4, and as the liquid passes through the volute chamber 13, the velocity energy is converted to pressure energy and the liquid is pressurized. The pressurized liquid is discharged from the discharge port 14. Vanes 15 of the impeller 4 faces an inner surface 11*a* of the casing liner 11, and a gap of a predetermined size is formed between the vanes 15 and the inner surface 11*a*.

Figure 2:
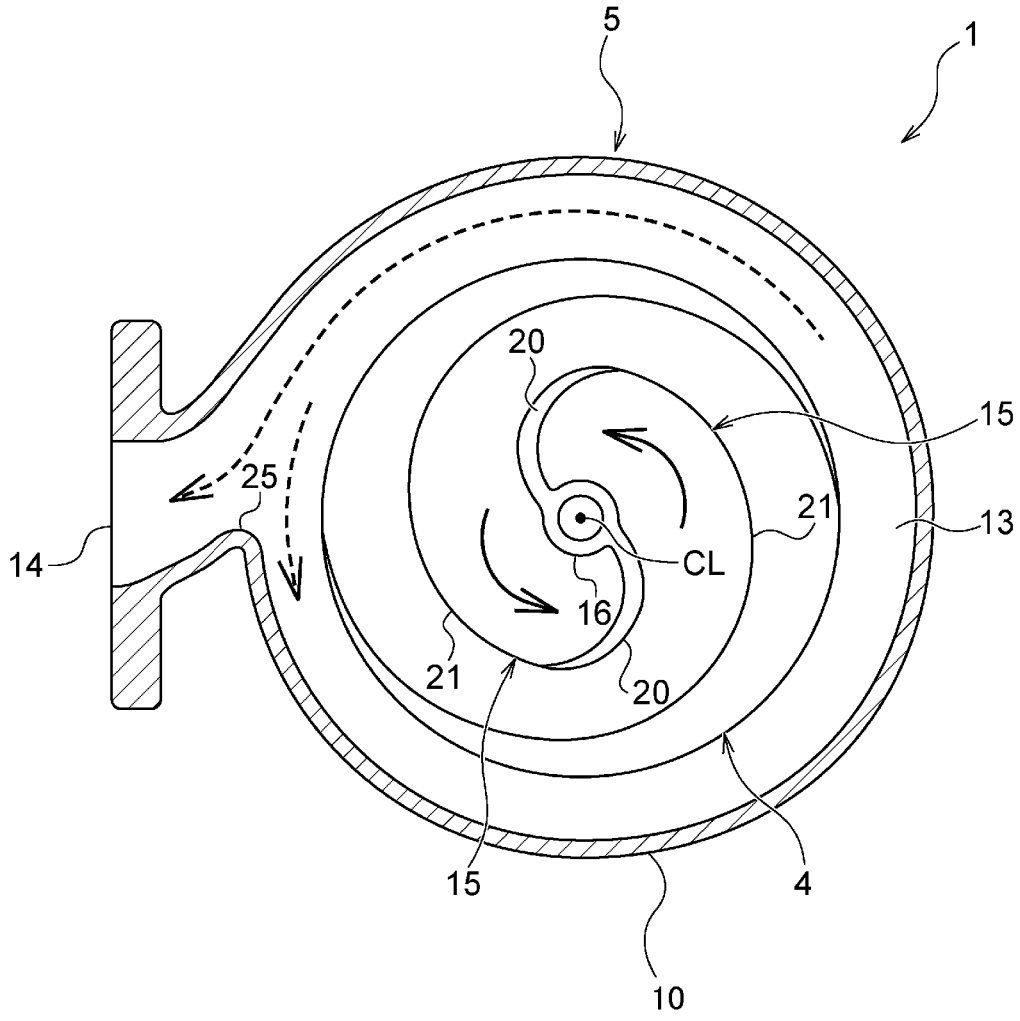
FIG. 2 is an A-A line cross section of FIG. 1.

FIG. 2 is an A-A line cross section of FIG. 1. As shown in FIG. 2, the impeller 4 includes a plurality of vanes 15 (two in this embodiment) and a boss portion 16 to which the vanes 15 are fixed. The vanes 15 rotate with the rotational shaft 3 about the boss portion 16 (see solid arrow in FIG. 2).

As shown in FIG. 2, the pump casing 5 has a tongue portion 25 that constitutes a beginning of a winding of the volute chamber 13. The volute chamber 13 extends along a circumferential direction of the impeller 4, and the liquid flowing through the volute chamber 13 is divided at the tongue portion 25. Thus, most of the liquid flows to the discharge port 14 while some of the liquid circulates in the volute chamber 13 (see dotted arrows in FIG. 2).

In the embodiment shown in FIG. 2, the vane 15 is a retreating vane. More specifically, the vane 15 has a leading edge portion 20 extending spirally from the boss portion 16 and a trailing edge portion 21 extending spirally from the leading edge portion 20. The leading edge portion 20 and the trailing edge portion 21 are connected to each other, and are integrally constructed.

The leading edge portion 20 is arranged radially inward of the suction port 12. The trailing edge portion 21 is opposite the inner surface 11*a* of the casing liner 11 (see FIG. 1). Thus, when the casing liner 11 is viewed from a direction of an axis CL of the rotational shaft 3, the leading edge portion 20 is arranged to be exposed from the casing liner 11 and the trailing edge portion 21 is arranged behind the casing liner 11.

As described above, the liquid to be handled by the pump apparatus PA may contain foreign matter such as fibrous substances or solid substances. The leading edge portion 20 of the vane 15 is arranged radially inward of the suction port 12. Therefore, when the liquid to be handled is sucked into the suction port 12 by the rotation of the impeller 4, the foreign matter may adhere to and accumulate on the leading edge portion 20. If the impeller 4 rotates in this state, the foreign matter may become trapped in the gap between the trailing edge portion 21 and the inner surface 11*a* of the casing liner 11, resulting in the pump 1 being blocked.

Therefore, to prevent blockage of the pump by the foreign matter, the pump 1 (more specifically, the pump casing 5) includes a cutter 30 that cuts (and/or grinds) the foreign matter. Configurations of the cutter 30 are described below with reference to the drawings.

Figure 3:
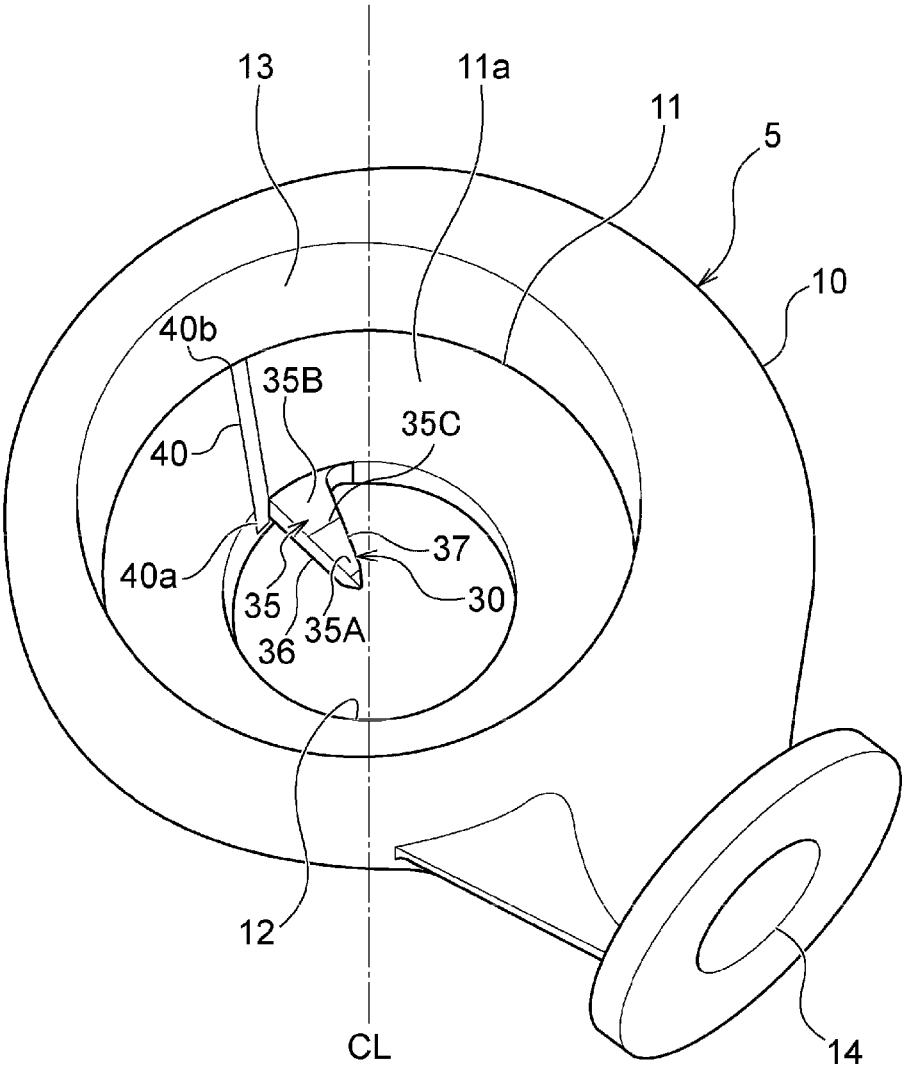
FIG. 3 is a view showing a cutter viewed from diagonally above.
Figure 4:
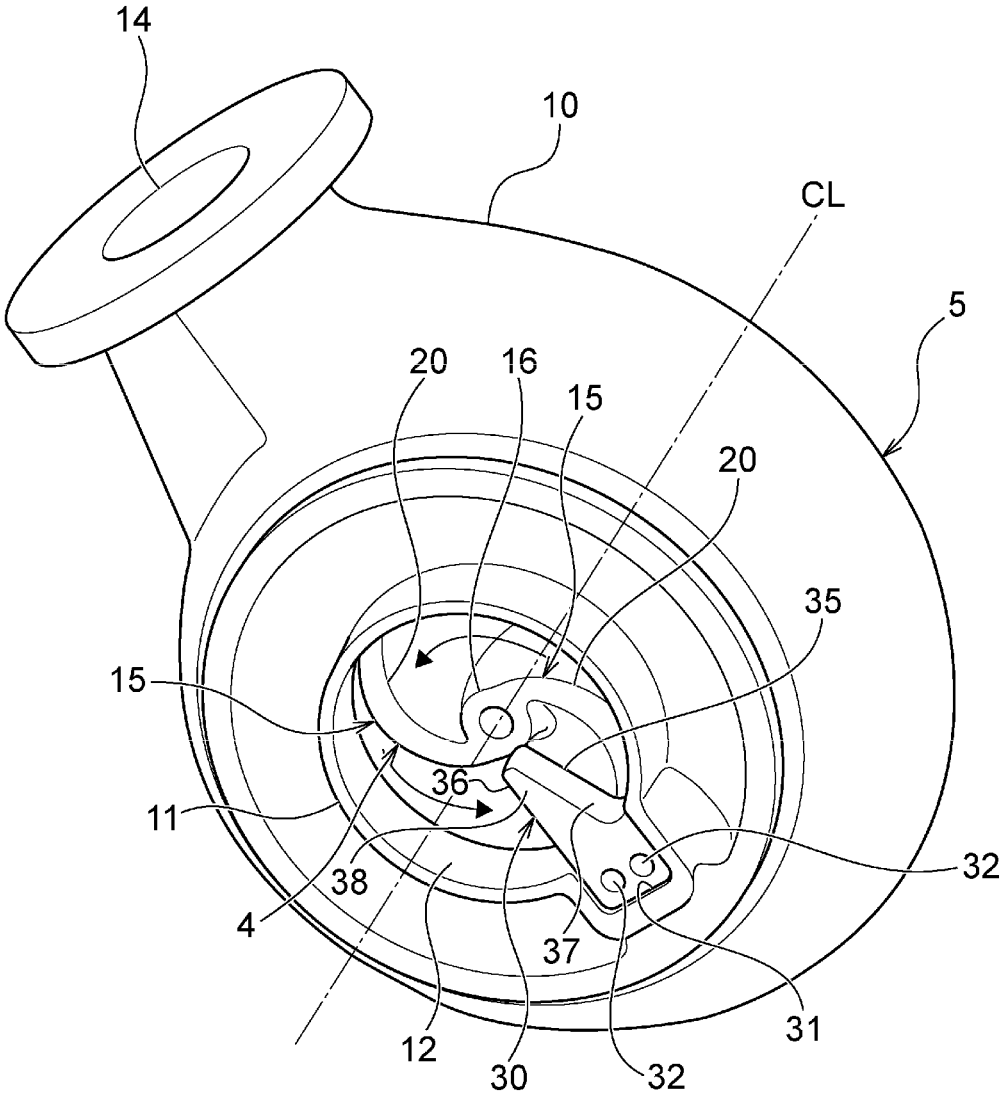
FIG. 4 is a view showing the cutter viewed from diagonally downward.

FIG. 3 is a view showing the cutter viewed from diagonally above. FIG. 4 is a view showing the cutter viewed from diagonally downward. The shape of the cutter 30 is not limited, but in the embodiment shown in FIGS. 3 and 4, when the cutter 30 is viewed from the axis CL direction, the cutter 30 has a tapered shape. The cutter 30 is fixed to the casing liner 11 of the pump casing 5, and protrudes from the suction port 12 so as to obstruct a flow path of the liquid passing through the suction port 12. The cutter 30 has a length that covers the leading edge portion 20.

In the embodiment shown in FIG. 4, the casing liner 11 has a cutter mounting portion 31 connected to the suction port 12. The cutter mounting portion 31 is a recess extending radially outward from the suction port 12, and the cutter 30 is fixed to the cutter mounting portion 31 by two fasteners 32. The number of fasteners 32 is not limited to this embodiment. When the impeller 4 is housed in the pump casing 5, a gap having a predetermined size is formed between the cutter 30 and the leading edge portion 20.

In this embodiment, the cutter 30 is constructed of a different member from the casing liner 11. With this configuration, even if the cutter 30 becomes worn, an operator can easily replace the cutter 30. Furthermore, by arranging a spacer (not shown) between the cutter 30 and the casing liner 11, the operator can adjust a size of the gap between the cutter 30 and the leading edge portion 20. In one embodiment, the cutter 30 may be an integrally molded member with the casing liner 11.

When the impeller 4 is housed in the pump casing 5, the cutter 30 has an upper surface 35 facing the leading edge portion 20 of the vane 15, a forward side surface 36 located forward in the direction of rotation of the impeller 4 (see arrow in FIG. 4), a backward side surface 37 located backward in the direction of rotation of the impeller 4, and a lower surface 38 located on an opposite side of the upper surface 35. In this embodiment, the forward side surface 36 and the backward side surface 37 are connected to the upper surface 35 and the lower surface 38, and a vertical cross sectional shape of the cutter 30 has a rectangular shape.

Figure 5:
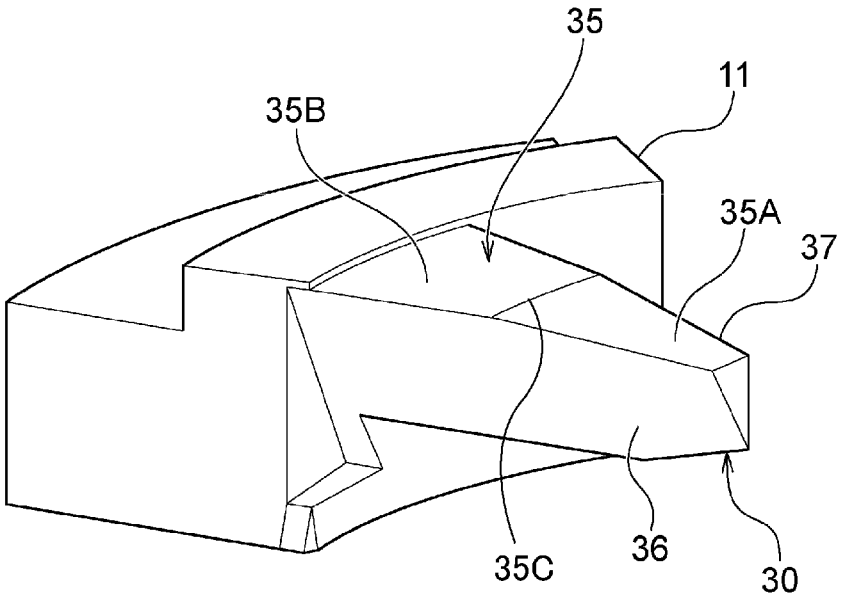
FIG. 5 is a view showing another embodiment of the cutter.

FIG. 5 is a view showing another embodiment of the cutter. In the embodiment shown in FIG. 5, the cutter 30 does not have the lower surface 38, and the vertical cross sectional shape of the cutter 30 has a triangular shape. Thus, the vertical cross sectional shape of the cutter 30 may have the rectangular shape or the triangular shape.

When the impeller 4 rotates by driving the motor 2, the foreign matter in the liquid is captured by the cutter 30 arranged at the suction port 12. The captured foreign matter is cut by the cutter 30. Some of the cut foreign matter is caught by the forward side surface 36 of the cutter 30, and moved into the volute chamber 13 by the rotating impeller 4. The foreign matter is then discharged to the outside through the discharge port 14.

Other portions of the cut foreign matter enter the gap between the upper surface 35 and the leading edge portion 20 and are cut (grinded) by the cutter 30. More specifically, the foreign matter moves to the trailing edge portion 21 side, while being sandwiched between the upper surface 35 and the leading edge portion 20 and being grinded by the rotating leading edge portion 20. The foreign matter then moves to the volute chamber 13, and is discharged to the outside through the discharge port 14.

In the embodiments shown in FIGS. 4 and 5, the cutter 30 has a different structure. The liquid containing the foreign matter is sucked into the pump casing 5 with great vigor. Therefore, the cutter 30 is able to cut the trapped foreign matter regardless of its vertical cross sectional shape (see FIGS. 4 and 5).

Figure 6:
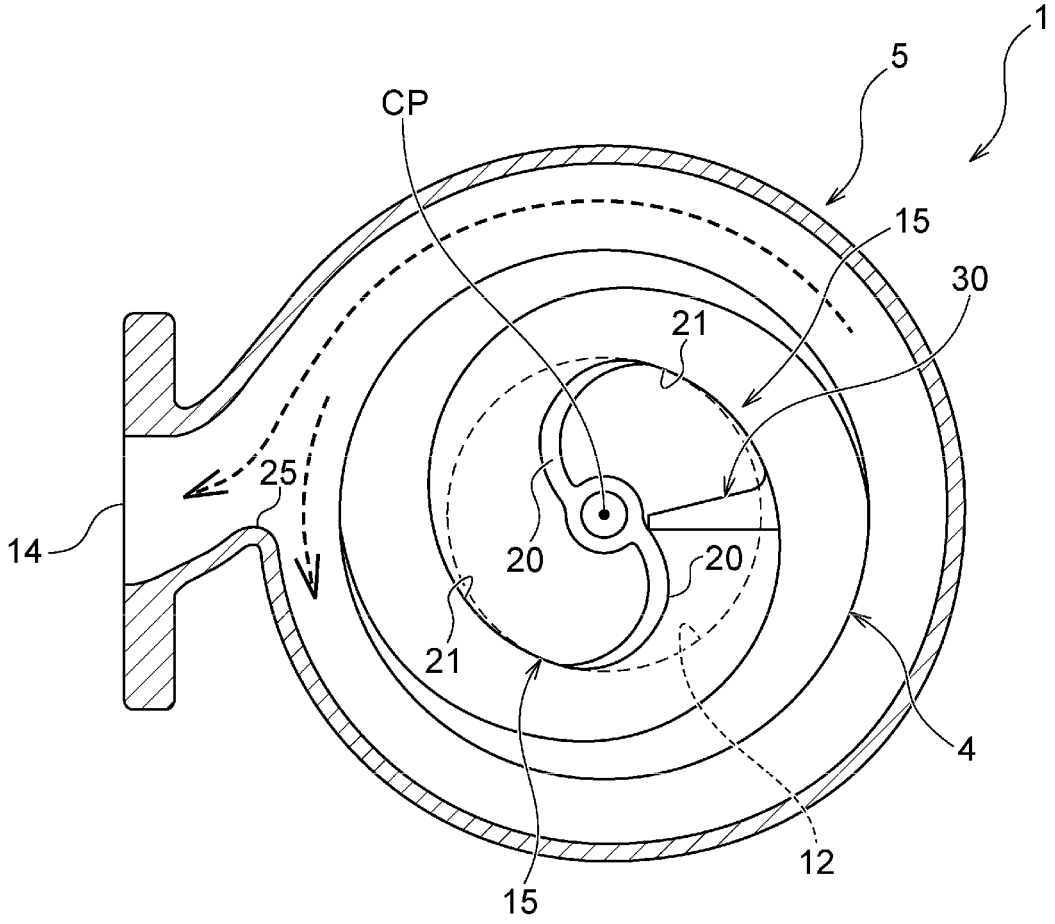
FIG. 6 is a view showing a positional relationship between a discharge port and the cutter.

FIG. 6 is a view showing a positional relationship between the discharge port and the cutter. As shown in FIG. 6, the cutter 30 is arranged on an opposite side of the discharge port 14 with respect to a center CP of the suction port 12. The center CP of the suction port 12 coincides with a direction of the axis CL. The tongue portion 25 is arranged adjacent to the discharge port 14. Due to this arrangement, the foreign matter is released into the volute chamber 13 at a position opposite to the tongue portion 25. The foreign matter is then moved through the volute chamber 13 by the flowing liquid while being subjected to centrifugal force. Therefore, the foreign matter is discharged out of the discharge port 14 without being caught by the tongue portion 25. As a result, the foreign matter is prevented from being trapped in the tongue portion 25.

Figure 7:
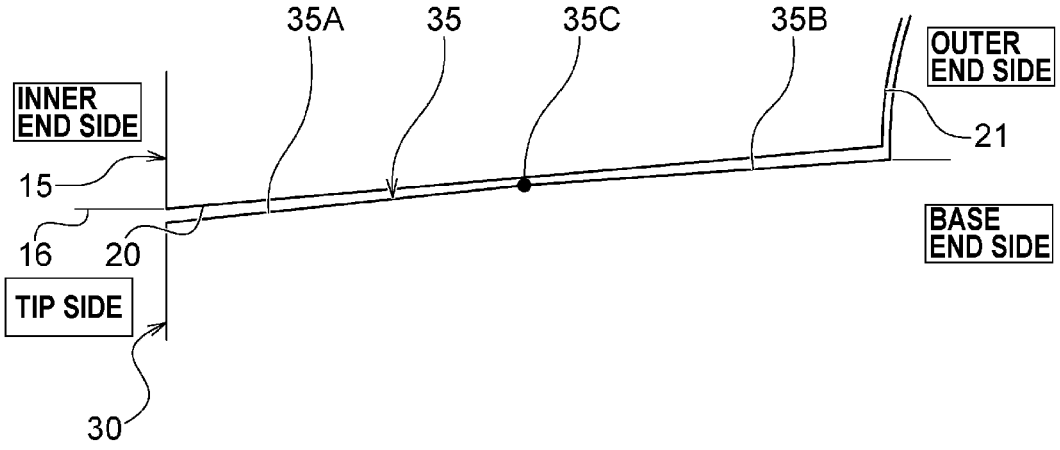
FIG. 7 is a view showing an upper surface of the cutter opposite a leading edge portion.

FIG. 7 is a view showing the upper surface of the cutter opposite the leading edge portion. As shown in FIG. 7, the upper surface 35 of the cutter 30 has a region having at least two angles (inclined angles). In this embodiment, the upper surface 35 of the cutter 30 has an inner end side region 35A arranged on an inner end side of the leading edge portion 20, an outer end side region 35B arranged on an outer end side of the leading edge portion 20, and a boundary portion 35C arranged between the inner end side region 35A and the outer end side region 35B. The inner end side region 35A is arranged on a tip side of the cutter 30. Therefore, the inner end side region 35A may be referred to as a tip side region. Similarly, the outer end side region 35B is arranged on a base end side of the cutter 30. Therefore, the outer end side region 35B may be referred to as a base end side region. A black dot indicating the boundary portion 35C is a virtual point to indicate a position of the boundary portion 35C in an easy-to-understand manner.

An inner end of the leading edge portion 20 is defined as a portion of the leading edge portion 20 adjacent to the boss portion 16, and an outer end of the leading edge portion 20 is defined as a portion of the leading edge portion 20 adjacent to the trailing edge portion 21. In this embodiment, the region formed on the upper surface 35 of the cutter 30 is divided by the boundary portion 35C into the inner end side region 35A and the outer end side region 35B. The outer end side region 35B slopes downward from a base end side of the cutter 30 to the tip side, and the inner end side region 35A slopes downward from the outer end side region 35B to the tip side of the cutter 30.

Figure 8A:
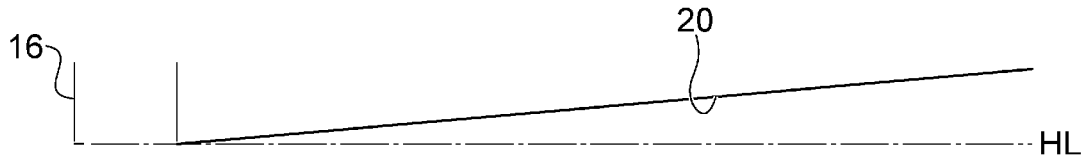
FIG. 8A is a view for illustrating an angle between the leading edge portion of a vane and the upper surface of the cutter.
Figure 8B:
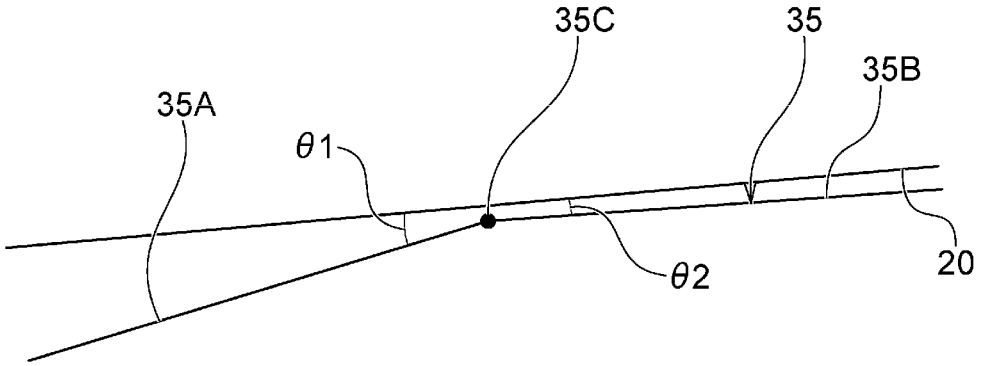
FIG. 8B is a view for illustrating an angle between the leading edge portion of the vane and the upper surface of the cutter.
Figure 8C:
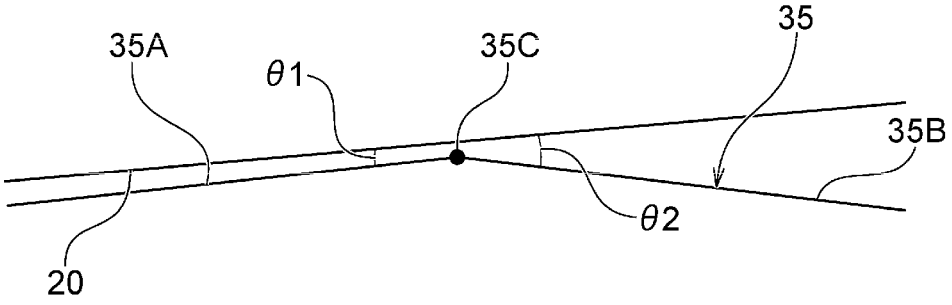
FIG. 8C is a view for illustrating an angle between the leading edge portion of the vane and the upper surface of the cutter.

FIGS. 8A to 8C are views for illustrating an angle between the leading edge portion of the vane and the upper surface of the cutter. In FIGS. 8A to 8C, the angles are exaggerated to make the drawings easier to read.

As shown in FIG. 8A, when the impeller 4 is housed in the pump casing 5, the boss portion 16 extends parallel to a horizontal line HL, and the leading edge portion 20 extends at an upward angle to the horizontal line HL. In other words, the leading edge portion 20 has a tapered shape extending obliquely upward from the boss portion 16.

As shown in FIG. 8B, an angle θ1 between the inner end side region 35A and the leading edge portion 20 is larger than an angle θ2 between the outer end side region 35B and the leading edge portion 20 (θ1>θ2). The angle θ1 is larger than the angle θ2, and therefore, the foreign matter contained in the liquid actively enters a gap between the inner end side region 35A of the upper surface 35 and the leading edge portion 20. The foreign matter that has entered the gap moves from the inner end side region 35A to the outer end side region 35B due to the rotation of the leading edge portion 20.

As shown in FIG. 8B, a gap between the boundary portion 35C and the leading edge portion 20 is smaller than the gap between inner end side region 35A and the leading edge portion 20 and a gap between the outer end side region 35B and the leading edge portion 20. In other words, the boundary portion 35C is closest to the leading edge portion 20 on the upper surface 35 of the cutter 30. Thus, the foreign matter moving from the inner end side region 35A to the outer end side region 35B is crushed by the leading edge portion 20 and the boundary portion 35C, and cut into smaller pieces.

The boundary portion 35C may have a curved shape that smoothly connects the inner end side region 35A and the outer end side region 35B, or have an angular shape that connects the inner end side region 35A and the outer end side region 35B at a predetermined angle (more specifically, an obtuse angle). The shape of the boundary portion 35C may be determined based on factors such as a material, a size and a length of the foreign matter in the liquid.

In this embodiment, each of the inner end side region 35A and the outer end side region 35B has a planar shape. In one embodiment, at least one of the inner end side region 35A and the outer end side region 35B may have a curved surface shape (i.e., convex shape) that extends in an arc in a direction proximate to the leading edge portion 20. In another embodiment, at least one of the inner end side region 35A and the outer end side region 35B may have a curved surface shape (i.e., concave shape) that extends in an arc in a direction away from the leading edge portion 20. The inner end side region 35A and the outer end side region 35B may have curved surface shapes having the same curvature or different curvatures.

In this embodiment, the boundary portion 35C is arranged adjacent to a central portion of the leading edge portion 20 (see FIG. 7). In one embodiment, the boundary portion 35C may be arranged proximate to the inner end side of the central portion of the leading edge portion 20, and in another embodiment, the boundary portion 35C may be arranged proximate to the outer end side of the leading edge portion 20.

As described above, the angle θ2 is smaller than the angle θ1. Therefore, the foreign matter passing through the boundary portion 35C is positively grinded by the outer end side region 35B and the leading edge portion 20. The grinded foreign matter is discharged into the volute chamber 13 together with the liquid.

The pump casing 5 may have a groove 40 formed on an inner surface of the pump casing 5 (see FIG. 3). The groove 40 is arranged an upstream of the cutter 30 in the direction of rotation of the impeller 4, and adjacent to the cutter 30. More specifically, the groove 40 is formed on the inner surface 11*a* of the casing liner 11, and extends from the suction port 12 to the volute chamber 13. The forward side surface 36 of the cutter 30 is connected to a beginning end 40*a* of the groove 40, and a terminal end 40*b* of the groove 40 is connected to the volute chamber 13.

Figure 9:
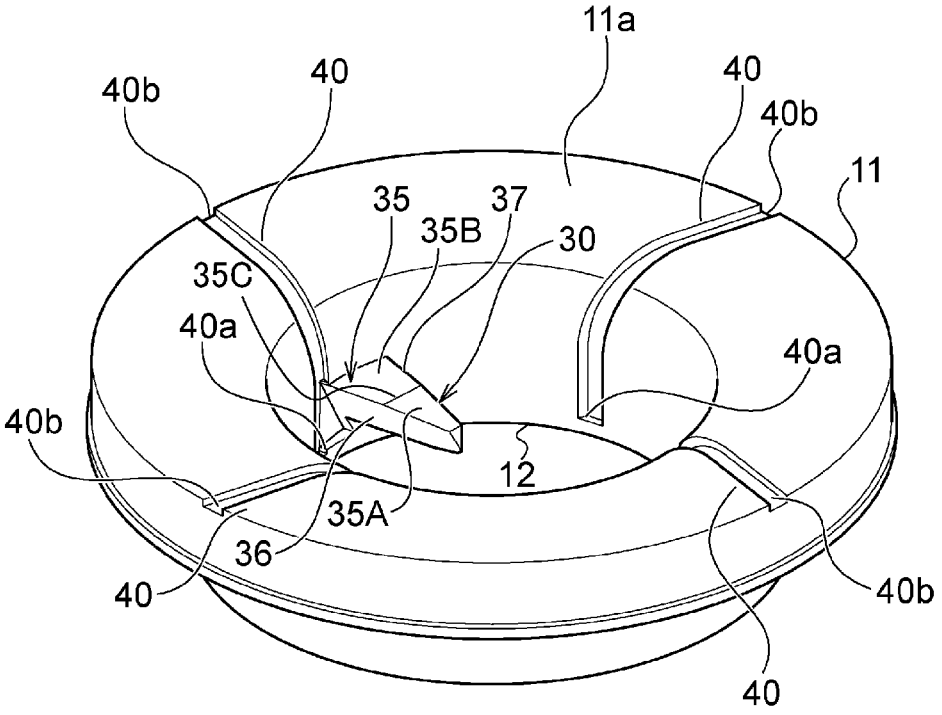
FIG. 9 is a view showing a plurality of grooves formed on an inner surface of the pump casing.

FIG. 9 is a view showing a plurality of grooves formed on an inner surface of the pump casing. As shown in FIG. 9, the pump casing 5 may have the grooves 40 formed on the inner surface of the pump casing 5. In the embodiment shown in FIG. 9, the grooves 40 are arranged along a circumferential direction of the suction port 12, and the cutter 30 is arranged adjacent to one of the grooves 40. The cutter 30 shown in FIG. 9 has the same structure as the cutter 30 according to the embodiment shown in FIG. 5, but may have the same structure as the cutter 30 according to the embodiment shown in FIG. 3.

In the embodiment shown in FIG. 8B, the angle θ1 is larger than the angle θ2, but as shown in FIG. 8C, the angle θ1 can be smaller than the angle θ2 (θ1<θ2). In other words, the angle θ2 between the outer end side region 35B and the leading edge portion 20 is larger than the angle θ1 between the inner end side region 35A and the leading edge portion 20. Due to this structure, the foreign matter that enters the gap between the inner end side region 35A and the leading edge portion 20 is actively grinded down by the inner end side region 35A and the leading edge portion 20. In the embodiment shown in FIG. 8C, the boundary portion 35C is also closest to the leading edge portion 20 on the upper surface 35 of the cutter 30. Thus, the foreign matter is cut into smaller pieces by the leading edge portion 20 and the boundary portion 35C.

By making the angle θ2 larger than the angle θ1, the leading edge portion 20 can actively move the grinded foreign matter toward the trailing edge portion 21. When the pump casing 5 has the groove 40, the leading edge portion 20 can actively push the foreign matter into the groove 40. With the foreign matter in the groove 40 moves along the groove 40 and is released into the volute chamber 13 at the terminal end 40*b* of the groove 40. The foreign matter received by the forward side surface 36 of the cutter 30 is guided through the forward side surface 36 into the groove 40, and are released from the groove 40 into the volute chamber 13 by the rotation of the impeller 4.

Figure 10:
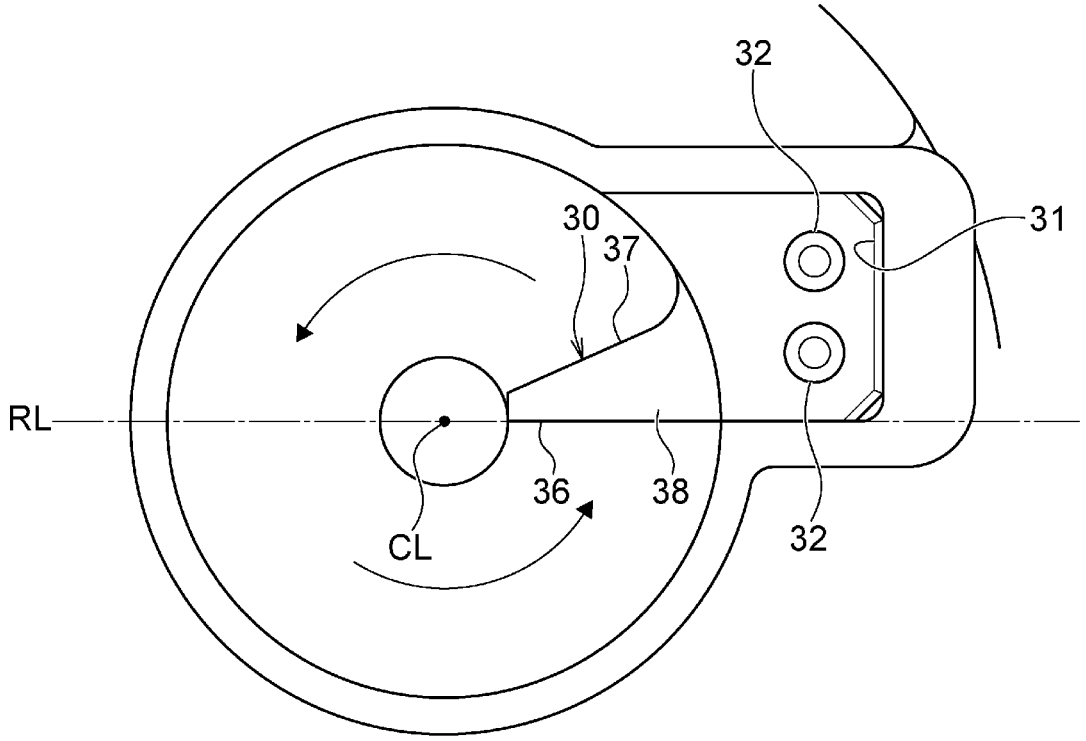
FIG. 10 is a view showing a forward side surface of the cutter with a planar shape.
Figure 11:
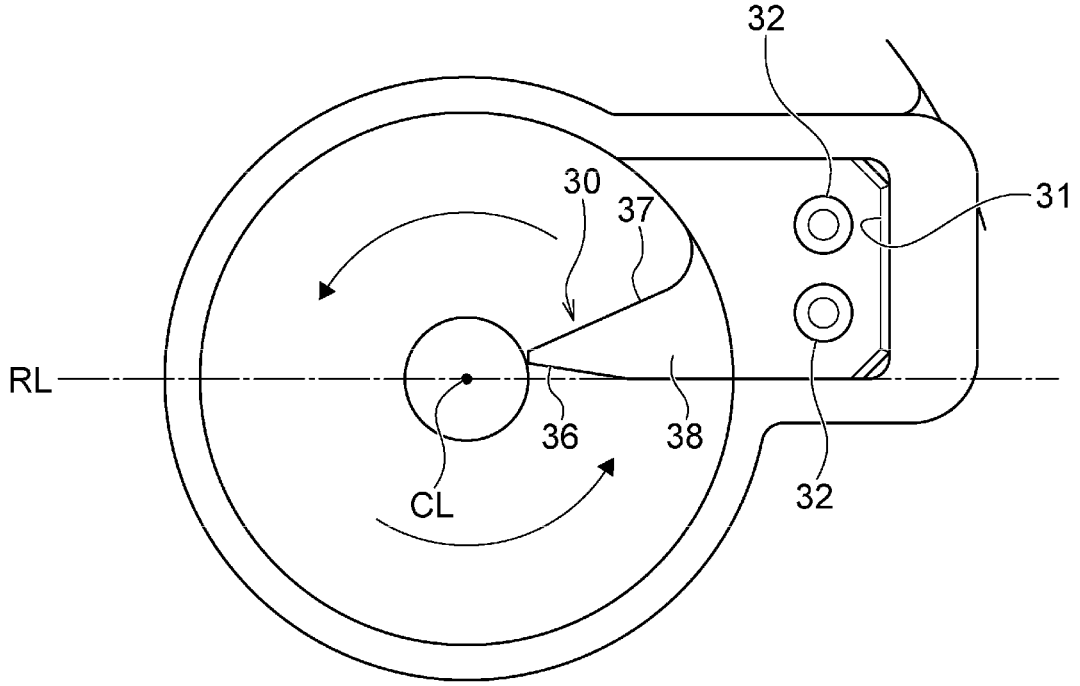
FIG. 11 is a view showing the forward side surface of the cutter bent at a predetermined angle.
Figure 12:
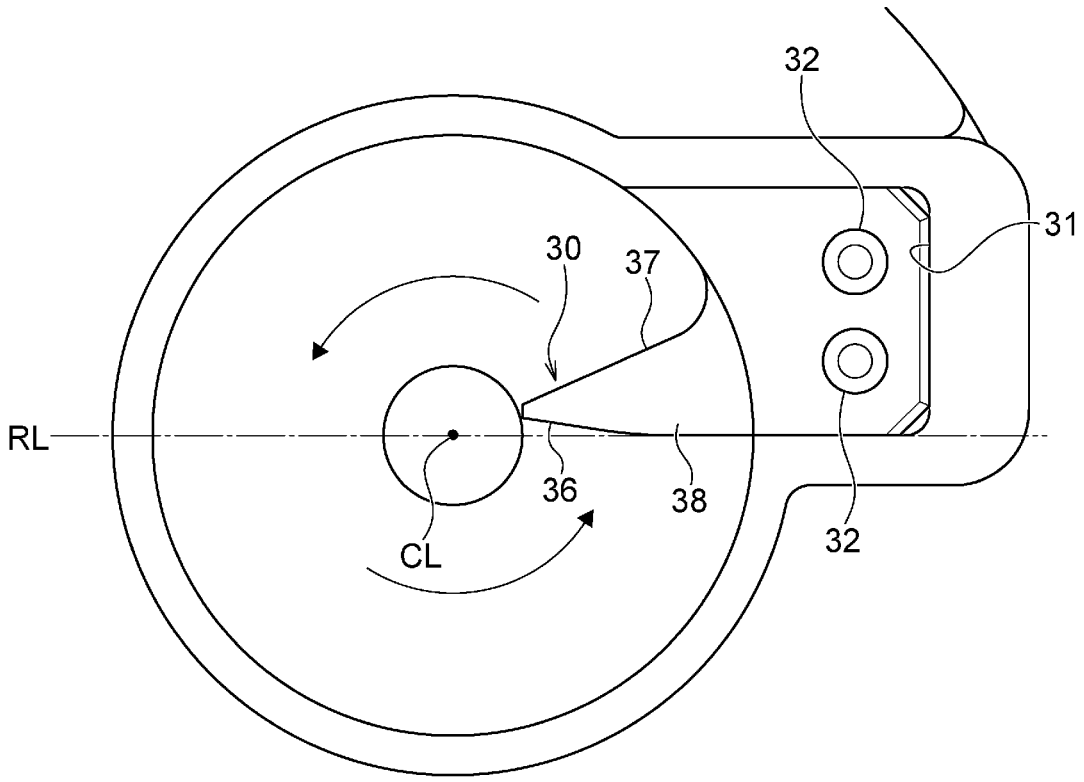
FIG. 12 is a view showing the forward side surface of the cutter having a curved shape.

FIG. 10 is a view showing the forward side surface of the cutter with a planar shape. FIG. 11 is a view showing the forward side surface of the cutter bent at a predetermined angle. FIG. 12 is a view showing the forward side surface of the cutter having a curved shape. In the embodiment shown in FIG. 10, the forward side surface 36 of the cutter 30 has a planar shape parallel to a reference line RL, which extends perpendicular to the direction of the axis CL. In the embodiment shown in FIG. 11, the forward side surface 36 extending parallel to the reference line RL has a shape bent in the direction of rotation of the impeller 4 (see arrow in FIG. 11) in a middle thereof. In the embodiment shown in FIG. 12, the forward side surface 36 has a curved shape extending in an arc in the direction of rotation of the impeller 4 (see arrow in FIG. 12).

An operator may select the shape of the forward side surface 36 of the cutter 30 based on factors such as a material, a size and a length of the foreign matter in the liquid. In particular, if the cutter 30 has a structure that can be removed from the casing liner 11, the operator may change the cutter 30 with a different forward side surface 36 as appropriate for an installation of the pump apparatus PA.

Figure 13A:
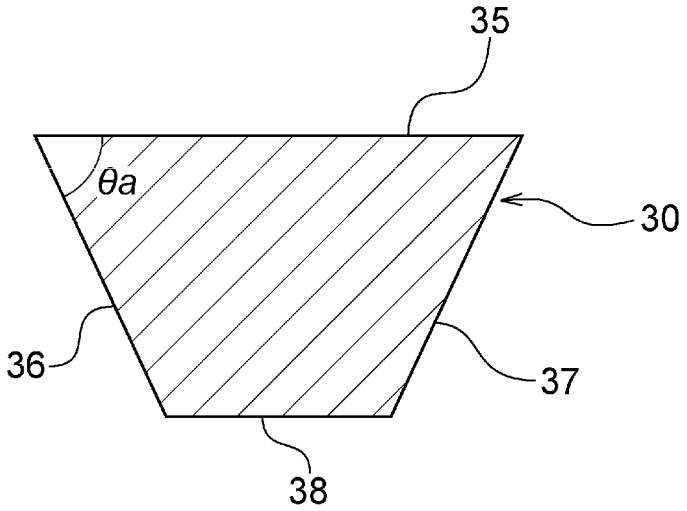
FIG. 13A is a view showing an angle between an upper surface of the cutter and the forward side surface of the cutter.
Figure 13B:
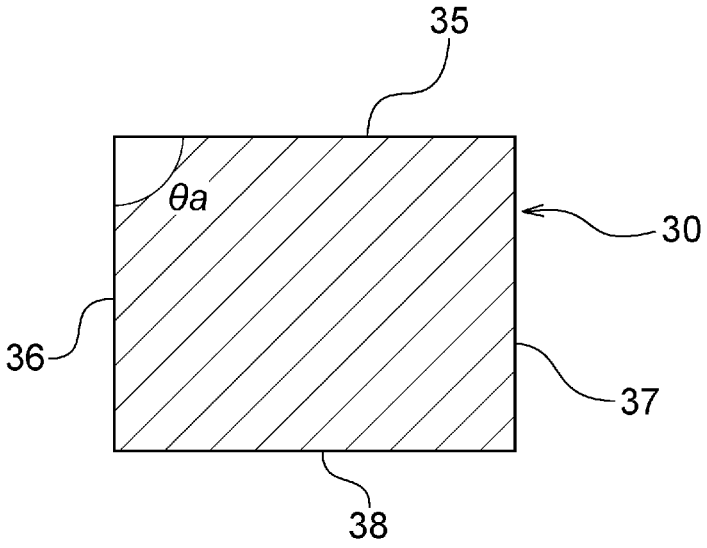
FIG. 13B is a view showing an angle between the upper surface of the cutter and the forward side surface of the cutter.
Figure 13C:
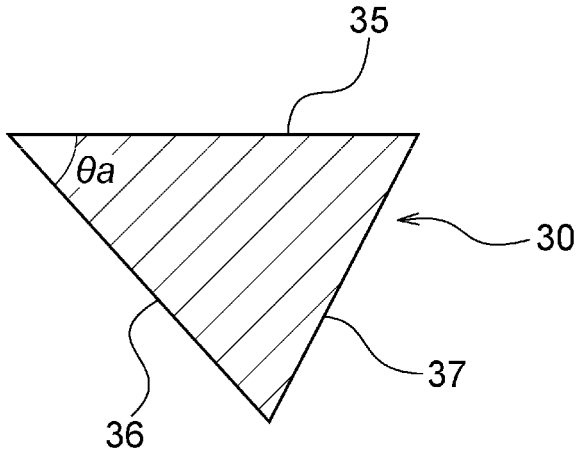
FIG. 13C is a view showing an angle between the upper surface of the cutter and the forward side surface of the cutter.

FIGS. 13A to 13C are views showing angles between the upper surface of the cutter and the forward side surface of the cutter. As shown in FIGS. 13A and 13C, the angle θa between the upper surface 35 and the forward side surface 36 may be an acute angle, or the angle θa may be a right angle (90 degrees), as shown in FIG. 13B. If the angle θa is an acute angle, the angle θa may be between 45 degrees to 58 degrees. Although not shown in the drawings, if it can achieve the effect described above, the angle θa may be an obtuse angle.

In the embodiment shown in FIG. 13C, the cutter 30 does not have the lower surface 38, and a vertical cross sectional shape of the cutter 30 has a triangular shape. As shown in FIGS. 13A to 13C, the vertical cross sectional shape of the cutter 30 may have a rectangular shape or a triangular shape.

The above embodiment describes the upper surface 35 of the cutter 30 having two regions (i.e., inner end side region 35A and outer end side region 35B), but the regions of the upper surface 35 of the cutter 30 are not limited to two regions. In one embodiment, the upper surface 35 of the cutter 30 may have regions with three or more angles (inclined angles).

The above embodiments are described for the purpose of practicing the present invention by a person with ordinary skill in the art to which the invention pertains. Although preferred embodiments have been described in detail above, it should be understood that the present invention is not limited to the illustrated embodiments, but many changes and modifications can be made therein without departing from the appended claims.

INDUSTRIAL APPLICABILITY

The present invention is applicable to a pump casing and a pump.

REFERENCE SIGNS LIST

1 pump
2 motor
3 rotational shaft
4 impeller
5 pump casing
6 mechanical seal
7 fastener
10 casing body
11 casing liner
11*a* inner surface
12 suction port
13 volute chamber
14 discharge port
15 vane
16 boss portion
20 leading edge portion

21 trailing edge portion
25 tongue portion
30 cutter
31 cutter mounting portion
32 fastener
35 upper surface
35A inner end side region (tip side region)
35B outer end side region (base end side region)
35C boundary portion
36 forward side surface
37 backward side surface
38 lower surface
40 groove
40*a* beginning end
40*b* terminal end

What is claimed is:

1. A pump casing configured to house an impeller, comprising, a cutter extending perpendicularly to a bore configured to house a rotational shaft coupled to the impeller, the cutter having an upper surface configured to face away from a suction port of the casing, wherein when viewed from a side, an outer end side region of the upper surface of the cutter extends at an angle to a centerline of the bore, and an inner end side region of the upper surface of the cutter, located adjacent to and radially inward from the outer end side region, is angled relative to the outer end side region such that a boundary portion dividing the inner end side region and the outer end side region extends across the upper surface, wherein a first side surface of the cutter, a second side surface of the cutter, and the upper surface of the cutter together create a triangular-shaped cross-section in a region of the inner end side region of the upper surface of the cutter.

2. The pump casing according to claim 1, further comprising:

a casing body configured to be arranged around the impeller; and a casing liner connected to the casing body and to which the cutter is fixed.

3. The pump casing according to claim 2, wherein the cutter is an integrally molded member with the casing liner.

4. The pump casing according to claim 1, further comprising a discharge port, and wherein the cutter is arranged on an opposite side of the discharge port with respect to a center of the suction port.

5. The pump according to claim 1, further comprising a groove formed on an inner surface of the pump casing, and wherein the groove is arranged adjacent to the cutter.

6. A pump, comprising:

the pump casing of claim 1, and the impeller, the pump casing housing the impeller, wherein the upper surface of the cutter faces a leading edge portion of the impeller.

7. The pump according to claim 6, wherein:

the inner end side region is arranged on an inner end side of the leading edge portion; and the outer end side region is arranged on an outer end side of the leading edge portion, and wherein an angle between the inner end side region and the leading edge portion is larger than an angle between the outer end side region and the leading edge portion.

8. The pump according to claim 7, wherein the upper surface has a boundary portion arranged between the inner end side region and the outer end side region, and wherein the upper surface is configured such that a gap between the boundary portion and the leading edge portion widens from the boundary portion toward the inner end side region, and a gap between the boundary portion and the leading edge portion widens from the boundary portion toward the outer end side region.

9. The pump according to claim 7, wherein the leading edge portion is disposed radially inward of the suction port.

10. The pump according to claim 7, wherein the inner end side region is a tip side region disposed on a tip side of the cutter, and wherein the outer end side region is a base end side region disposed on a base end side of the cutter.

11. The pump according to claim 6, wherein:

the inner end side region is arranged on an inner end side of the leading edge portion; and the outer end side region is arranged on an outer end side of the leading edge portion, and wherein an angle between the outer end side region and the leading edge portion is larger than an angle between the inner end side region and the leading edge portion.

12. The pump according to claim 6, wherein a gap between the boundary portion and the leading edge portion is smaller than a gap between the inner end side region and the leading edge portion and a gap between the outer end side region and the leading edge portion.

13. The pump according to claim 12, wherein the boundary portion has a curved shape that smoothly connects the inner end side region and the outer end side region.

14. The pump according to claim 12, wherein the boundary portion has an angular shape that connects the inner end side region and the outer end side region at a predetermined angle.

15. The pump according to claim 6, wherein:

the first side surface is a forward side surface located forward in a direction of rotation of the impeller; and the second side surface is a backward side surface located backward in the direction of rotation of the impeller.

16. The pump according to claim 15, wherein the forward side surface has a planar shape.

17. The pump according to claim 15, wherein the forward side surface has a shape bent at a predetermined angle.

18. The pump according to claim 15, wherein the forward side surface has a curved surface shape.

* * * * *